United States Patent [19]

Bowman

[11] Patent Number: 4,583,646

[45] Date of Patent: Apr. 22, 1986

[54] SECTIONAL RACK FOR CAPS AND THE LIKE

[75] Inventor: James M. Bowman, Joplin, Mo.

[73] Assignee: B. Quad, Inc., Joplin, Mo.

[21] Appl. No.: 630,690

[22] Filed: Jul. 13, 1984

[51] Int. Cl.[4] ..... A47F 7/06

[52] U.S. Cl. ..... 211/32; 211/181

[58] Field of Search ..... 211/32, 181, 30, 118, 211/119, 132, 13

[56] References Cited

U.S. PATENT DOCUMENTS

| | | | |
|---|---|---|---|
| 413,467 | 10/1889 | Webber | 211/32 |
| 572,336 | 12/1896 | Dawson | 211/181 X |
| 906,894 | 12/1908 | Kevorkian | 211/181 X |
| 908,392 | 12/1908 | Casteel | 211/181 X |
| 959,839 | 5/1910 | Buehler | 211/181 X |
| 996,421 | 6/1911 | McCausland | 211/181 X |
| 1,663,366 | 3/1928 | Berry | 211/119 |
| 1,752,985 | 4/1930 | Huffman | 211/181 X |
| 3,391,891 | 7/1968 | Garden | 211/181 X |

*Primary Examiner*—Ramon S. Britts
*Assistant Examiner*—Sarah A. Lechok Eley
*Attorney, Agent, or Firm*—Litman, Day & McMahon

[57] ABSTRACT

A sectional rack including hanger, vertical and shelf sections. The vertical section is releasably attached to the hanger section. The shelf section foldably attaches to one of the hanger and vertical sections and includes a pair of arms interconnected by a front bar. The shelf section is adapted to receive a cap on its arms with a visor thereof extending under the front bar.

4 Claims, 5 Drawing Figures

SECTIONAL RACK FOR CAPS AND THE LIKE

BACKGROUND OF THE INVENTION

1. Field of the Invention

The present invention relates to racks, and in particular to a sectional rack for storing and displaying caps.

2. Description of the Prior Art

Caps have long enjoyed popularity as headgear for outdoor sports, work and other activities. The fronts of caps may contain various indicia which identify, for example, the wearer or an athletic team of which he or she is a member or supporter. Furthermore, many companies distribute caps with their logos and company names prominently displayed.

A variety of devices for storing and displaying hats, caps and the like have heretofore been proposed. For example, the Farwell U.S. Pat. No. 621,911 discloses a hat tray for propping against a wall with a plurality of hat-holes each having a foldable rack or bale 10 associated therewith. Hats are inserted into the hat-holes of the Farwell tray and rest on the racks thereof in their folded down positions. The Hutt U.S. Pat. No. 116,706 discloses a wire hat rack with a loop adatped to receive a nail and a wire section forming a rest for the crown of a hat.

The prior art also includes hat racks comprising foldable sections as exemplified by the Pfeil U.S. Pat. No. 2,494,487 and the Jacobson U.S. Pat. No. 2,535,136. However, none of the aforementioned devices is particularly well adapted for the storage and display of caps. For merchandising purposes, it may be desirable to prominently display a number of caps for viewing and selection by customers. To facilitate the display of caps as merchandise, the storage and display device should include as little structure as possible to avoid detracting from or obscuring the caps themselves. Horizontal shelving may be provided for displaying caps and the like, but typically requires mechanical attachment to a wall surface at several locations. Also, shelves spaced closely together for maximum space utlization tend to obstruct the view of objects either directly above or below the individual shelves.

Caps may also be placed on hooks, but each hook must be individually attached to a wall surface. Also, many caps have emblems or logos on their fronts which would not be readily visible with the cap suspended from a hook and the emblem or logo facing downwardly. Thus, conventional alternatives such as shelving and hooks suffer from serious disadvantages for marketing caps and the like and prior art hat holders are not particularly well designed for merchanidising caps. In addition to merchandisers, private individuals who maintain cap collections will also benefit from a device which provides for the prominent display of a number of caps.

SUMMARY OF THE INVENTION

In the practice of the present invention, a sectional rack is provided which includes hanger, vertical and shelf sections. The hanger section includes a loop, a pair of legs extending from the loop, a pair of feet extending from the legs and a cross-bar. The vertical section includes a pair of legs, a pair of hooks adapted to receive the hanger cross-bar, a base and a cross-bar. The shelf section includes a pair of arms, a pair of back legs having hooks adapted to receive a hanger or vertical section cross-bar, a pair of front legs and a shelf front bar interconnecting the shelf front legs. The shelf is adapted to receive a cap with a band thereof placed on its arms and a visor thereof extending under the shelf front bar.

OBJECTS OF THE INVENTION

The objects of the present invention are: to provide a sectional rack including hanger, vertical and shelf sections; to provide such a rack to which vertical and shelf sections may be added as desired, to provide such a rack which is adapted for hanging on a wall; to provide such a rack wherein the hanger and vertical sections may be disconnected for shipping or storage; to provide such a rack wherein the shelf sections are foldable with respect to the hanger and vertical sections; to provide such a rack which is adapted for securely and releasably retaining caps thereon; to provide such a rack wherein each shelf section is adapted for receiving and displaying a plurality of caps in nested configurations; and to provide such a rack which is efficient in operation, economical to manufacture, capable of a long operating life and particularly well adapted for the proposed usage thereof.

DETAILED DESCRIPTION OF THE PREFERRED EMBODIMENTS

Figure 1:
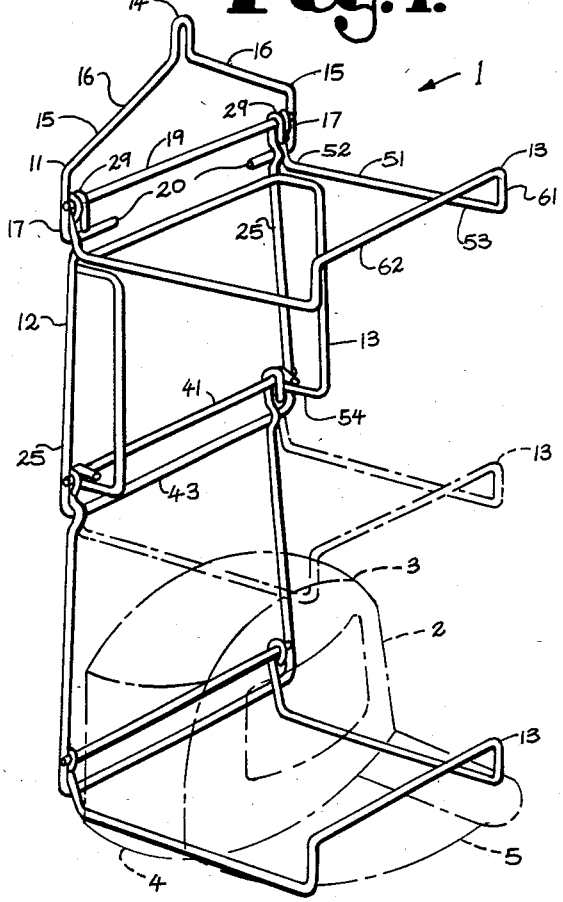
FIG. 1 is a perspective of a sectional rack for caps and the like embodying the present invention.
Figure 2:
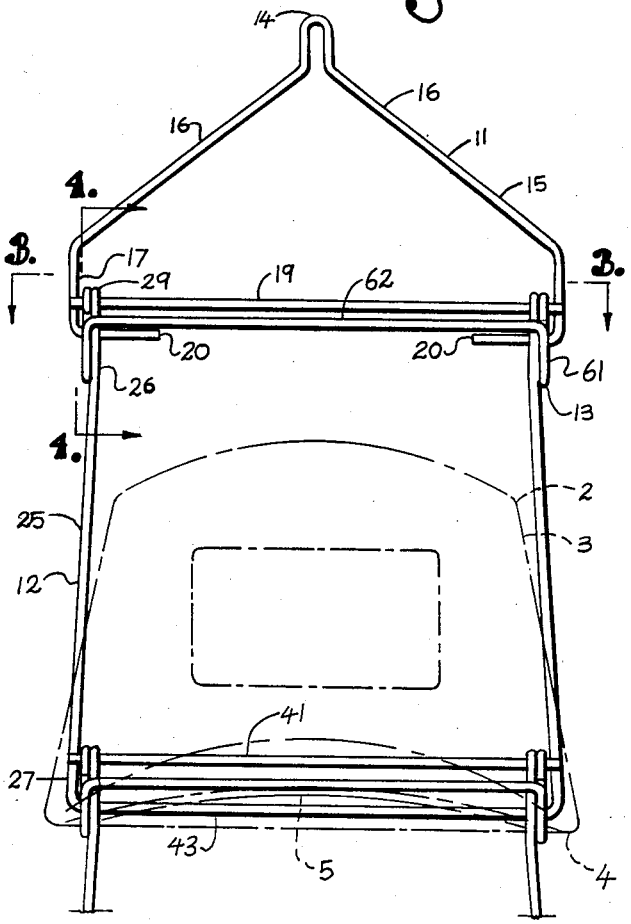
FIG. 2 is a fragmentary front elevation of the rack.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a sectional rack for caps such as that shown at 2 and the like. The cap 2 includes a crown 3 open at a band 4 and a forwardly extending visor 5. Although the sectional rack 1 is particularly designed for storing and displaying caps such as that shown at 2, various other items may be placed thereon.

The rack 1 generally comprises a hanger section 11 and a plurality of vertical and shelf sections 12, 13. The sections 11–13 are formed of wire which may be electroplated with a material such as chrome for corrosion and rust resistance.

The hanger section 11 is substantially symmetrical when viewed from the front and includes a downwardly-open hanger section loop 14 centered at its apex. A pair of hanger section legs 15 with front faces 21 extend from the loop 14 and include outwardly and downwardly sloping proximate portions 16 and upright distal portions 17. A cross-bar 19 is welded to the leg front faces 21 and extends transversely between and interconnects the leg distal portions 17. The leg distal portions 17 terminate at inwardly extending feet 20.

A plurality of vertical sections 12 are suspended from the hanger section 11 in interlocking relationship. Each vertical section 12 includes a pair of vertical section legs 25 with a top and a bottom 26, 27. Each leg top 26 includes a return 28 forming a hook 29 and terminating at a return end 30. The return 28 is substantially parallel to the leg top 26 and is spaced therefrom so that the inside width of the hook 29 is slightly greater than the thickness of the wire forming the rack 1. A hook opening 31 is formed between the return end 30 and the leg top 26. The leg top 26 includes a forwardly-extending bight portion 32 forming a rearwardly-open notch 33. The bight portion 32 is located immediately below the hook opening 31. The hook 29 terminates at a blind end 34.

A vertical section cross-bar 41 extends transversely between the legs 25 and is attached, for example by welding, to front faces 42 thereof. A base 43 is integrally formed with the vertical section legs 25 and extends transversely between their bottoms 27 in parallel, spaced relation slightly below and parallel to the vertical section cross-bar 41.

The spacing between the front section cross-bar 41 and the front section base 43 corresponds to the spacing between the notch 33 and the hook blind end 34 so that when one vertical section 12 is suspended from another, the hook blind end 34 and the notch 33 of the upper vertical section 12 respectively receive the cross-bar 41 and the base 43 of the lower vertical section 12. Furthermore, the notch 33 has a depth approximately equal to the thickness of the wire forming the rack 1. The cross-bar 41, being attached to the leg front face 42, is spaced forwardly from the notch 33 approximately the thickness of the wire. Therefore, the legs 25 of interconnected vertical sections 12 are substantially coplanar and are adapted to lie flush against a wall or other vertical surface such as that shown at 46. The hanger section cross-bar 19 and feet 20 have the same spacing as the vertical section cross-bars 41 and bases 43 so that any of the vertical sections 12 may be suspended from either the hanger section 11 or another vertical section 12. The hanger section legs 15 also lie flat against the vertical surface 46 in coplanar relationship with the vertical section legs 25.

Each shelf section 13 includes a pair of horizontally extending arms 51 with back and front ends 52, 53. Back legs 54 extend upwardly from the arm back ends 52. The back legs 54 include returns 57 terminating at return ends 58 and forming hooks 56 with blind ends 59. The hook returns 57 are angled toward the shelf legs 54 from the hook blind ends 59 to the return ends 58 so that shelf hook openings 60 are narrower than the thickness of the wire. Thus, the shelf hooks 56 are preferably formed over the cross-bars 19, 41 in the manufacture of the racks 1 and are removable therefrom by bending the hooks 56 open. Alternatively, the hooks 56 may be formed in a more open configuration to remove the shelf sections 13 at will from the hanger and vertical sections 11, 12.

A pair of front legs 61 extend upwardly from the arm front ends 53 and are interconnected by a transverse front bar 62 integral with the front legs 61. The front bar 62 extends parallel to and in spaced relation above a plane defined by the arms 51 so that the visor 5 of the cap 2 on the shelf section 13 can extend thereunder. The arms 51 are spaced apart a distance slightly less than the normal width of the cap 2 so that its band 4 overhangs slightly outwardly from the arms 51. The visor 5 engages the shelf section front legs 61 and is retained thereby. Thus, forward and lateral movement of the cap 2 is limited on the shelf section 13 and the cap 2 is relatively securely retained thereon. Placement and removal of the cap 2 on a shelf section 13 is accomplished by tilting the cap 2 so that its visor 5 points downwardly whereby it can be withdrawn from underneath the shelf front bar 62.

Figure 3:
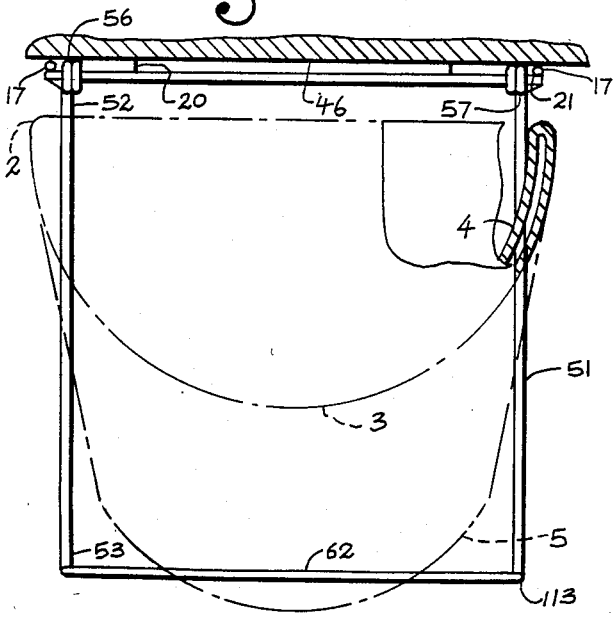
FIG. 3 is a horizontal cross section of the rack taken generally along line 3—3 in FIG. 2.

The band 4 of the cap 2 may be folded double as shown in FIG. 3 so that a plurality of caps may be "nested" on a single shelf with the collapsed crown 3 of one cap being received within the crown of the next cap forward. The visors of such nested caps are stacked one on top of the other. Thus, the rack 1 is particularly well suited for displaying a collection of caps or for merchandising purposes wherein a plurality of caps 2 may be placed on each shelf section 13. Furthermore, additional vertical and shelf sections 12, 13 may be added to the rack 1 as required to achieve virtually any desired overall height.

The rack 1 is easily broken down for shipping in a compact configuration with the hanger and vertical sections 11, 12 separated and the shelf sections 13 mounted thereon folded to shipping or storage positions with their arms 51 substantially parallel to the hanger section leg distal portions 16 and the vertical section legs 25.

The rack 1 is assembled by inserting the cross-bars 19, 41 in respective hooks 29. The rack may be suspended from a nail or the like by its loop 14. The shelf sections 13 are pivotal about axes extending through respective cross-bars 19, 41 and are folded to their use positions with their arms 51 extending substantially horizontally and forwardly from the hanger and vertical sections 11, 12. With the shelf sections 13 in their horizontal use positions, their back legs 54 engage the feet 20 of the hanger section 11 and the bases 43 of respective vertical sections 12 which limit further rotation downwardly. In their use positions, the shelf sections 13 cantilever from the hanger and vertical sections 11, 12 and are each adapted to support the weight of several caps 2.

Figure 5:
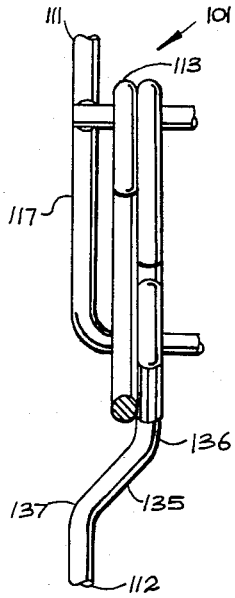
FIG. 5 is a fragmentary front elevation of a sectional rack for caps and the like comprising a first modified embodment of the present invention.
Figure 4:
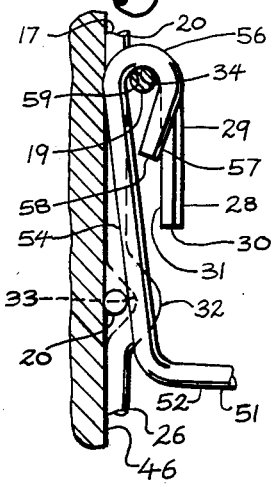
FIG. 4 is a vertical cross section of the rack taken generally along line 4—4 in FIG. 2.

A sectional rack comprising a first modified embodiment of the present invention is shown in FIG. 5 and generally designated by the reference numeral 101. The modified sectional rack 101 includes hanger, vertical and shelf sections 111, 112 and 113. The vertical section 112 has an inward offset 135 comprising upper and lower bends 136, 137. The offset 135 is positioned below a vertical section bight portion 132 and serves to align leg distal portions 117 of the hanger section 111 with legs 125 of the vertical section 112.

It is to be understood that while certain forms of the present invention have been illustrated and described herein, it is not to be limited to the specific forms or arrangement of parts described and shown.

What is claimed and desired to be secured by Letters Patent is as follows:

1. A sectional rack for caps and the like, which comprises:

(a) a wire hanger section including:

(1) a loop at an apex of said hanger section;

(2) a pair of legs each including a proximate portion extending outwardly and downwardly from said loop and an upright distal portion extending downwardly from said proximate portion;

(3) a pair of feet each extending inwardly from a respective leg proximate portion, said feet terminating in mutually opposed, spaced relationship; and (4) a hanger cross-bar extending transversely between said leg distal portions in spaced relation above said feet;

(b) a wire vertical section including:

(1) a pair of legs each having a top and a bottom, a return forming a hook at said top and a forwardly extending bight portion at said top in spaced relation below said hook, said bight portion forming a rearwardly-open notch;

(2) a base integrally connected to and extending transversely between said leg bottom portions; and (3) a cross-bar extending transversely between said leg bottom portions in spaced, parallel relation above said base;

(4) said hooks being adapted for receiving said hanger cross-bar whereby said vertical section is suspended from said hanger section; and (c) a wire shelf section including:

(1) a pair of arms each having back and front ends;

(2) a pair of back legs each integrally connected to and extending from a respective arm back end;

(3) a pair of returns integral with said back legs and each forming a respective shelf hook pivotally recieving one of said hanger and vertical section cross-bars;

(4) a pair of front legs extending from said arm front ends; and (5) a front bar extending transversely between said front legs in parallel, spaced relation to a plane defined by said shelf arms.

2. A sectional rack, which comprises:

(a) a wire hanger section including loop means at an apex thereof, a pair of legs each extending downwardly from said apex and a hanger cross-bar extending transversely between said hanger legs;

(b) an upper wire vertical section including:

(1) a pair of legs each having a top with a hook and a bottom, each said hook pivotally receiving said hanger section cross-bar whereby said vertical section is suspended from said hanger section;

(2) a base integrally connected to and extending transversely between said leg bottom portions; and (3) a vertical section cross-bar extending transversely between said leg bottom portions in spaced, parallel relation above said base;

(c) a lower wire vertical section including:

(1) a pair of legs each having a top with a hook and a bottom, each said hook pivotally receiving said upper vertical section cross-bar whereby said vertical section is suspended from said hanger section;

(2) a base internally connected to and extending transversely between said leg bottom portions; and;

(3) a vertical section cross-bar extending transversely between said leg bottom portions in spaced, parallel relation above said base; and (d) a wire shelf section including:

(1) a pair of arms each having front and back ends;

(2) a pair of back legs each integrally connected to and extending from a respective arm back end and having a hook pivotally receiving one of said hanger section and vertical section crossbars; and (3) a front bar extending transversely between said arm front ends.

3. The sectional rack according to claim 2, which includes:

(a) each said vertical section leg having a bight portion forming a rearwardly open notch adapted to receive a respective hanger section foot.

4. The sectional rack according to claim 2, which includes:

(a) a pair of shelf section front legs extending from said arm front ends;

(b) said shelf section front bar extending transversely between said front legs in substantially parallel, spaced relation from a plane formed by said shelf section arms.

* * * * *